US007886440B2

(12) United States Patent
Hashimoto et al.

(10) Patent No.: US 7,886,440 B2
(45) Date of Patent: Feb. 15, 2011

(54) MANUFACTURE METHOD FOR INNER-FIN TUBE AND MANUFACTURE DEVICE FOR THE SAME

(75) Inventors: Noriaki Hashimoto, Handa (JP); Katsuji Hattori, Chita-gun (JP)

(73) Assignee: Denso Corporation, Kariya (JP)

( * ) Notice: Subject to any disclaimer, the term of this patent is extended or adjusted under 35 U.S.C. 154(b) by 1265 days.

(21) Appl. No.: 11/440,986

(22) Filed: May 25, 2006

(65) Prior Publication Data

US 2006/0265874 A1 Nov. 30, 2006

(30) Foreign Application Priority Data

May 30, 2005 (JP) ..... 2005-157203

(51) Int. Cl.
*B23P 15/26* (2006.01)

(52) U.S. Cl. ..... 29/890.049; 29/890.03; 29/890.053

(58) Field of Classification Search ..... 29/890.03–890.054
See application file for complete search history.

(56) References Cited

U.S. PATENT DOCUMENTS 6,470,570 B2 * 10/2002 Prater et al. ..... 29/890.053

FOREIGN PATENT DOCUMENTS

EP 1 090 698 4/2001
JP A-60-247426 12/1985
JP 5-115934 5/1993
JP 2003-336989 11/2003

OTHER PUBLICATIONS

Office Action dated Jun. 1, 2010 in corresponding Japanese Application No. 2005-157203.
Search Report for corresponding GB application No. GB0610404.6 dated Aug. 21, 2006.

* cited by examiner

*Primary Examiner*—Rick K Chang
(74) *Attorney, Agent, or Firm*—Harness, Dickey & Pierce, PLC

(57) ABSTRACT

A manufacture method for an inner-fin tube includes a tube forming process for continuously forming a tube member joined at one end side thereof, an inner fin transferring process for continuously transferring an inner fin member, an inner fin twisting process for twisting the transferred inner fin member at at least two portions, and an inner fin inserting process for inserting the inner fin member into the tube member through the one end side thereof at the halfway stage of the tube forming process. At the inner fin twisting process, a transfer direction of the inner fin member is altered so that the inner fin member faces the one end side of the tube member and a longitudinal direction of a cross section (perpendicular to transfer direction thereof) of the inner fin member corresponds with a major axis direction of a flat cross section of the tube member.

4 Claims, 2 Drawing Sheets

MANUFACTURE METHOD FOR INNER-FIN TUBE AND MANUFACTURE DEVICE FOR THE SAME

CROSS REFERENCE TO RELATED APPLICATION

This application is based on a Japanese Patent Application No. 2005-157203 filed on May 30, 2005, the disclosure of which is incorporated herein by reference.

FIELD OF THE INVENTION

The present invention relates to a manufacture method for an inner-fin tube and a manufacture device for the same, which are suitably used for a heat exchanger, for example.

BACKGROUND OF THE INVENTION

Generally, for example, referring to JP-2003-336989A, an inner-fin tube has a tube member and an inner fin member. The tube member is constructed of a band-shaped plate material by bending, to have a flat cross section. The tube member includes a bend portion and a swaged portion which are respectively arranged at two ends of the flat cross section. The inner fin member is constructed of a band-shaped plate material and arranged in the tube member. One end of the inner fin member contacts an inner wall of the bend portion of the tube member, and the other end of the inner fin member is fixed to the swaged portion of the tube member by swaging.

Therefore, a position deviation, a departure and the like of the inner fin member from the tube member are restricted. In this case, while the tube member and the inner fin member are continuously manufactured by a roller forming device, the inner fin member is continuously inserted into the tube member.

However, referring to JP-2003-336989A where the inner fin member is continuously inserted into the tube member via the roller forming device, the tube member and the inner fin member are formed in parallel and the inner fin member is bent toward a plate thickness direction of the band-shaped plate material to be merged into (inserted into) the tube member. The tube member is provided with an opening portion (where swaged portion will be provided) at a major-axis-direction end of the flat cross section of the tube member. After the inner fin member is inserted into the tube member, the side of the opening portion is swaged. Therefore, it is necessary for the inner fin member to be bent from the side of the major-axis-direction end of the flat cross section of the tube member in a width direction of the band-shaped plate material of the inner fin member, to be merged into the tube member through the opening portion.

However, generally, the band-shaped plate material cannot be bent in the width direction thereof, so that it is difficult for the continuous forming disclosed by JP-2003-336989A to be realized.

SUMMARY OF THE INVENTION

In view of the above-described disadvantages, it is an object of the present invention to provide a manufacture method for an inner-fin tube and a manufacture device for the same, via which a tube member and an inner fin member are continuously formed in parallel and the inner fin member is capable of being inserted into the tube member through the side of a major-axis-direction end of a flat cross section of the tube member.

According to an aspect of the present invention, a manufacture method is provided for an inner-fin tube which has a tube member and an inner fin member. The tube member is constructed of a first band-shaped plate member, which is bent so that the tube member defines therein a passenger with a flat cross section perpendicular to a longitudinal direction of the tube member and is joined at a side of one end of a major axis direction of the flat cross section. The inner fin member is constructed of a second band-shaped plate material and arranged in the tube member. The manufacture method includes a tube forming process for continuously forming the tube member by the first band-shaped plate material, an inner fin transferring process for continuously transferring the inner fin member constructed of the second band-shaped plate material in such a manner that the inner fin member is arranged in parallel to the tube member formed at the tube forming process, an inner fin twisting process for twisting the inner fin member transferred via the inner fin transferring process at at least two portions of the inner fin member and altering a transfer direction of the inner fin member, and an inner fin inserting process for inserting the inner fin member (transfer direction of which has been changed at inner fin twisting process) into the tube member through the side of the major-axis-direction one end of the flat cross section of the tube member which is at the halfway stage of the tube forming process. The inner fin twisting process is performed, so that the inner fin member faces the side of the major-axis-direction one end of the flat cross section of the tube member and a longitudinal direction of a cross section (perpendicular to transfer direction of inner fin member) of the inner fin member corresponds with the major axis direction of the flat cross section of the tube member.

In this case, the inner fin member and the tube member are continuously formed in parallel. The transfer direction of the inner fin member can be readily altered, and the inner fin member can be readily inserted through the one end side of the major axis direction of the flat cross section of the tube member.

Preferably, the two twisted portions which are formed at the inner fin twisting process have twist directions contrary to each other.

Thus, the transfer direction of the inner fin member can be altered into a desirable one, by a small twist angle. Therefore, an influence to the deformation of the inner fin member can be reduced.

More preferably, when the inner fin member is formed by the second band-shaped plate material, a protrusion portion is arranged at the second band-shaped plate material and extends in a longitudinal direction of the second band-shaped plate material.

Thus, even when the inner fin member is provided with wave-shaped portion (including protrusion portions when being viewed from one surface side of second band-shaped plate member), the transfer direction of the inner fin member can be altered via the inner fin twisting process. Accordingly, the inner fin member which has an enlarged heat conducting area via the wave-shaped portion can be readily dealt.

According to another aspect of the present invention, a manufacture device is provided to manufacture an inner-fin tube which has a tube member and an inner fin member. The tube member is constructed of a first band-shaped plate member, which is bent so that the tube member defines therein a passenger with a flat cross section perpendicular to a longitudinal direction of the tube member and is joined at a side of one end of a major axis direction of the flat cross section. The inner fin member is constructed of a second band-shaped plate material and arranged in the tube member. The manufacture device has a tube forming unit for continuously forming the tube member by the first band-shaped plate material, an inner fin transferring unit for continuously transferring the inner fin member constructed of the second band-shaped plate material in such a manner that the inner fin member is arranged in parallel to the tube member formed at the tube forming unit, an inner fin twisting unit for twisting the inner fin member transferred via the inner fin transferring unit at at least two portions and changing a transfer direction of the inner fin member, and an inner fin inserting unit for inserting the inner fin member (transfer direction of which has been changed via inner fin twisting unit) into the tube member through the side of the major-axis-direction one end of the flat cross section of the tube member which is formed at the halfway stage via the tube forming unit. The inner fin twisting unit is performed, so that the inner fin member faces the side of the major-axis-direction one end of the flat cross section of the tube member and a longitudinal direction of a cross section (perpendicular to transfer direction of inner fin member) of the inner fin member corresponds with the major axis direction of the flat cross section of the tube member.

In this case, the inner fin member and the tube member are continuously formed in parallel. The transfer direction of the inner fin member can be readily altered, and the inner fin member can be readily inserted through the one end side of the major axis direction of the flat cross section of the tube member.

Preferably, the inner fin transferring unit is constructed of a plurality of roller portions. The inner fin twisting unit is constructed of a plurality of roller portions which are arranged at different positions and have different rotation-axis incline directions, with respect to the linear transferring direction of the inner fin member.

Thus, the inner fin transferring unit and the inner fin twisting unit can be simply constructed via the multiple rollers.

BRIEF DESCRIPTION OF THE DRAWINGS

Other objects, features and advantages of the present invention will become more apparent from the following detailed description made with reference to the accompanying drawings, in which.

DETAILED DESCRIPTION OF THE EXAMPLE EMBODIMENTS

First Embodiment

Figure 1:
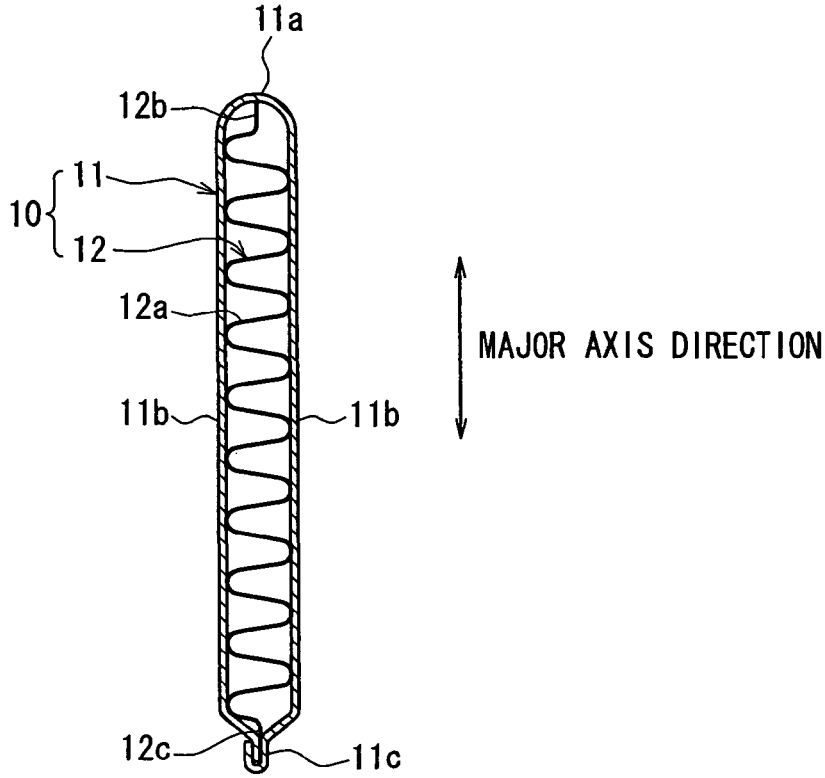
FIG. 1 is a cross-sectional view which shows a passage of an inner-fin tube and is perspective to a longitudinal direction of the inner-fin tube according to a first embodiment of the present invention.

A manufacture device 100 for manufacturing an inner-fin tube 10 according to a first embodiment of the present invention will be described with reference to FIGS. 1-3. As shown in FIG. 1, the inner-fin tube 10 includes an inner fin member 12 and a tube member 11, in which the inner fin member 12 is arranged. The inner-fin tube 10 can be suitably used for a heat exchanger (heat-exchanging portion) of an evaporator or the like which is provided in a refrigerant cycle device, for example.

The tube member 11, being made of aluminum or the like, is constructed of a band-shaped thin plate material (first band-shaped plate material) which is bent to have a pipe shape, for example. The tube member 11 defines therein a passage with a flat-shaped cross section which is perpendicular to a longitudinal direction of the tube member 11. That is, this cross section of the tube member 11 has a thin-long shape.

The tube member 11 is provided with a bend portion 11*a*, two flat plate portions 11*b* (i.e., plane plate portions) and a swaged portion 11*c*. The band-shaped plate material constructing the tube member 11 is bent at a substantial center of a width direction thereof, so that the bend portion 11*a* is formed. The two flat plate portions 11*b* which respectively extend from two sides of the bend portion 11*a* face each other. The opposite sides of the flat plate portions 11*b* to the bend portion 11*a* are swaged to construct the swaged portion 11*c*. Thus, the tube member 11 is formed. In this case, the swaged portion 11*c* and the bend portion 11*a* are respectively positioned at two major-axis-direction ends of the flat cross section of the tube member 11.

The inner fin member 12, being a fin member, provides a turbulence effect to fluid flowing in the passage defined in the tube member 11 and enlarges a heat conduction area of the tube member 11. Similar to the tube member 11, the inner fin member 12, being made of aluminum or the like, is constructed of a band-shaped thin plate material (second band-shaped plate material).

The inner fin member 12 is provided with a wave-shaped portion 12*a* by a roller process or the like. The wave-shaped portion 12*a* is formed at a substantial center of a width direction of the band-shaped plate material which constructs the inner fin member 12. In this case, the inner fin member 12 has the wave shape in the width direction thereof.

Moreover, the inner fin member 12 has two flat plate portions 12*b* and 12*c* which are respectively arranged at two ends of the width direction of the second band-shaped plate material. The flat plate portion 12*b*, 12*c* has a substantially plane plate shape in the width direction of the inner fin member 12.

The inner fin member 12 is inserted in the tube member 11. In this case, the flat plate portion 12*b* of the inner fin member 12 contacts an inner wall of the bend portion 11*a* of the tube member 11. The swaged portion 11*c* of the tube member 11 is swaged, with the flat plate portion 12*c* of the inner fin member 12 being sandwiched between the two flat plate portions 11*b* of the tube member 11.

In this case, the wave-shaped portion 12*a* of the inner fin member 12 can be provided with multiple protrusions (when being viewed from one surface side of second band-shaped plate material), each of which extends in a longitudinal direction of the band-shaped plate material constructing the inner fin member 12.

Figure 2:
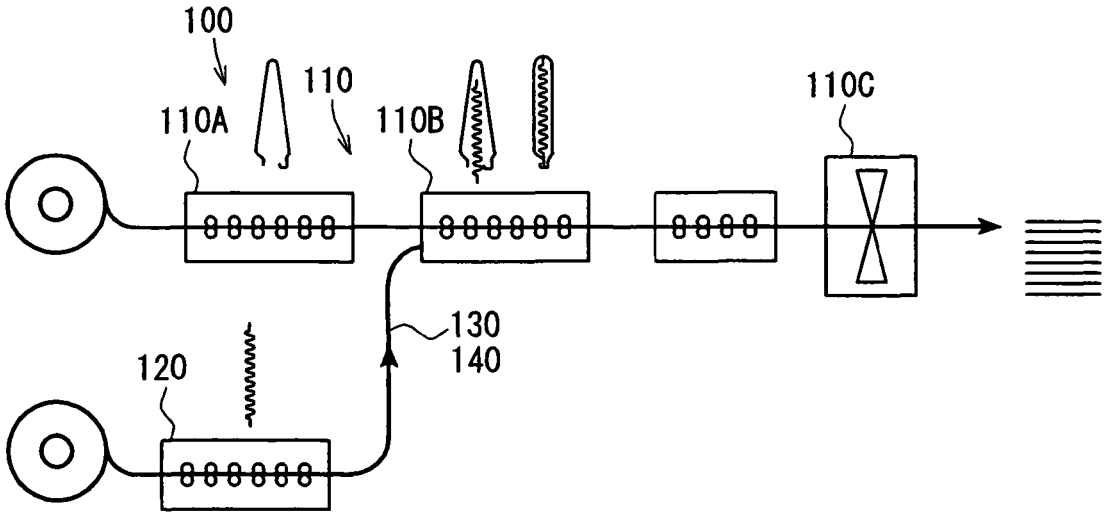
FIG. 2 is a schematic view showing a whole construction of a manufacture device for the inner-fin tube according to the first embodiment.

As shown in FIG. 2, the manufacture device 100 for manufacturing the inner-fin tube 10 includes a tube forming unit

110 for continuously forming the tube member 11 while inserting the inner fin member 12 into the tube member 11, an inner fin forming unit 120 for forming the inner fin member 12, an inner fin transferring unit 130 for transferring the inner fin member 12 having been formed to the side of the tube forming unit 110, an inner fin twisting unit 140 and the like.

The tube forming unit 110 has a tube integument forming portion 110A, an assembling/swaging portion 110B and a cutting portion 110C. The tube integument forming portion 110A forms the tube member 11 of an integument shape by the first band-shaped plate material having been rolled into a coil, by using multiple roller groups. The tube member 11 of the integument shape (integument state) is provided with the bend portion 11*a* and the flat plate portion 11*b*.

The assembling/swaging portion 110B is provided to insert the inner fin member 12 into the tube member 11 of the integument state, and forms the swaged portion 11*c* by using multiple roller groups. The cutting portion 110C is provided to cut a continuously-formed product coming from the assembling/swaging portion 110B at a predetermined length, to form the inner-fin tube 10.

The tube integument forming portion 110A, the assembling/swaging portion 110B and the cutting portion 110C are arrayed linearly. An feeding roller portion 111 (referring to FIG. 3) or the like is provided to transfer products from the tube integument forming portion 110A, the assembling/swaging portion 110B and the cutting portion 110C, so that forming processes of the tube integument forming portion 110A, the assembling/swaging portion 110B and the cutting portion 110C can be continuously performed.

The inner fin forming unit 120 is provided to form the band-shaped inner fin member 12 by the second band-shaped plate material having been rolled into the coil, by using multiple roller groups. As shown in FIG. 2, the inner fin member 12 of the band shape (band state) is provided with the wave-shaped portion 12*a* and the flat plate portions 12*b*, 12*c*. The band-shaped inner fin member 12 formed by the inner fin forming unit 120 is deviated form the integument-shaped tube member 11 formed by the tube integument forming portion 110A at a predetermined distance in a horizontal direction, and arranged in parallel to the integument-shaped tube member 11 at a lower side thereof.

Figure 3:
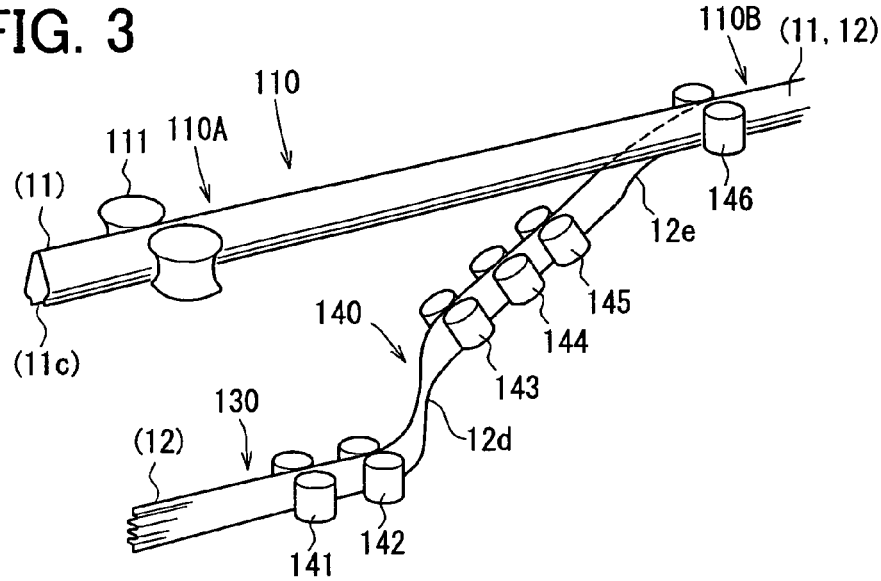
FIG. 3 is a perspective view showing an inner fin transferring unit and an inner fin twisting unit of the manufacture device according to the first embodiment.

As shown in FIG. 3, the inner fin transferring unit 130 has a feeding roller portion 141 and a haul roller portion 144 (e.g., each of which can be constructed of two rollers), to transfer the band-shaped inner fin member 12 having been formed by the inner fin forming unit 120 toward the assembling/swaging portion 110B.

The inner fin twisting unit 140 twists the band-shaped inner fin member 12, to guide the band-shaped inner fin member 12 to a front side of the assembling/swaging portion 110B. The inner fin twisting unit 140 includes a first twisting roller portion 142, a second twisting roller portion 143, a third twisting roller portion 145 and a fourth twisting roller portion 146, in addition to the roller portions 141 and 144.

The feeding roller portion 141 is arranged where the band-shaped inner fin member 12 is discharged from the inner fin forming unit 120, to transfer the band-shaped inner fin member 12 to the side of the assembling/swaging portion 110B.

The first twisting roller portion 142 is arranged near a continuation line of the band-shaped inner fin member 12 having past through the feeding roller portion 141. The second twisting roller portion 143 is arranged at a substantial center (at side of assembling/swaging portion 110B) between the integument-shaped tube member 11 and the band-shaped inner fin member 12. A rotation axis of the second twisting roller portion 143 is inclined toward that of the first twisting roller portion 142.

The haul roller portion 144 is provided to haul the band-shaped inner fin member 12 coming from the second twisting roller portion 143, to transfer the band-shaped inner fin member 12 further to the side of the assembling/swaging portion 110B.

As compared with the haul roller portion 144, the third twisting roller portion 145 is arranged closer to the side of the integument-shaped tube member 11. The fourth twisting roller portion 146 also serves as a feeding roller, and is arranged at a position where the band-shaped inner fin member 12 is combined with the integument-shaped tube member 11. That is, the fourth twisting roller portion 146 is disposed at a confluence position of the band-shaped inner fin member 12 and the integument-shaped tube member 11. A rotation axis of the fourth twisting roller portion 146 corresponds with the major axis direction of the flat-shaped cross section of the tube member 11.

Next, the operation of the manufacture device 100 and the effects thereof will be described.

At first, the tube member 11 of the integument shape (state) is formed by the first band-shaped plate material via the tube integument forming portion 110A of the tube forming unit 110. Moreover, at the inner fin forming unit 120, the band-shaped inner fin member 12 is formed. The band-shaped inner fin member 12 is moved to the side of the assembling/swaging portion 110B by the inner fin transferring unit 130 (constructed of feeding roller portion 141 and haul roller portion 144), while a transfer direction of the band-shaped inner fin member 12 and a longitudinal direction of the cross section thereof perpendicular to the longitudinal direction of the second band-shaped plate material (band-shaped inner fin member 12) are altered by the inner fin twisting unit 140.

The band-shaped inner fin member 12 is twisted between the first twisting roller portion 142 and the second twisting roller portion 143, toward the side of the integument-shaped tube member 11. Thus, a first twisted portion 12*d* is provided for the band-shaped inner fin member 12 between the first twisting roller portion 142 and the second twisting roller portion 143.

Moreover, the band-shaped inner fin member 12 is provided with a second twisted portion 12*e* which is formed between the third twisting roller portion 145 and the fourth twisting roller portion 146. A twist direction of the second twisted portion 12*e* is contrary to that of the first twisted portion 12*d*. The band-shaped inner fin member 12 is twisted between the third twisting roller portion 145 and the fourth twisting roller portion 146, so that the longitudinal direction of the cross section (which is perpendicular to transfer direction of band-shaped inner fin member 12) of band-shaped inner fin member 12 becomes to correspond with the major axis direction of the flat-shaped cross section of the integument-shaped tube member 11 and the band-shaped inner fin member 12 becomes along the transfer direction of the integument-shaped tube member 12 while facing the side of the one end (where swaged portion 11*c* will be formed) of the integument-shaped tube member 11.

Thus, the integument-shaped tube member 11 is provided therein with the band-shaped inner fin member 12, and the inner-fin tube 10 is constructed via the assembling/swaging portion 110B. Moreover, referring to FIG. 2, the continuously-formed inner-fin tube 10 is cut by the cutting portion 110C at a predetermined length. Thus, the one-by-one inner-fin tube 10 is accomplished, and stored in proper alignment in a predetermined area.

According to this embodiment, the tube member 11 and the inner fin member 12 are continuously formed in parallel. The transfer direction of the inner fin member 12 can be readily changed via the inner fin twisting unit 140. The inner fin member 12 can be readily inserted into the tube member 11 from the one end side (where swaged portion 11*c* will be provided) of the major axis direction of the flat-shaped cross section of the tube member 11.

In this case, the multiple roller portions 141-146 are provided to construct the inner fin transferring unit 130 and the inner fin twisting unit 140. Thus, the mechanism of the manufacture device 100 is simplified.

Moreover, in the inner fin twisting unit 140, the twist directions of the first twisted portion 12*d* and the second twisted portion 12*e* of the inner fin member 12 are set contrary to each other, so that the transfer direction of the inner fin member 12 can be changed into a preferred direction by a small twist angle and the influence on the deformation of the inner fin member 12 can be reduced.

In this embodiment, the inner fin member 12 is provided with the wave-shaped portion 12*a* (having multiple protrusions) for improving a heat conducting performance. Generally, when the inner fin member 12 is provided with the wave-shaped portion 12*a*, it is difficult to alter the transfer direction of the inner fin member 12 by bending the inner fin member 12 toward the width direction thereof. According to the first embodiment, the twisted portions 12*d* and 12*e* are formed via the inner fin twisting unit 140 so that the transfer direction of the band-shaped inner fin member 12 can be changed. Thus, the inner fin member 12 which is provided with the wave-shaped portion 12*a* for enlarging the heat-conducting area can be readily processed.

Second Embodiment

Figure 4:
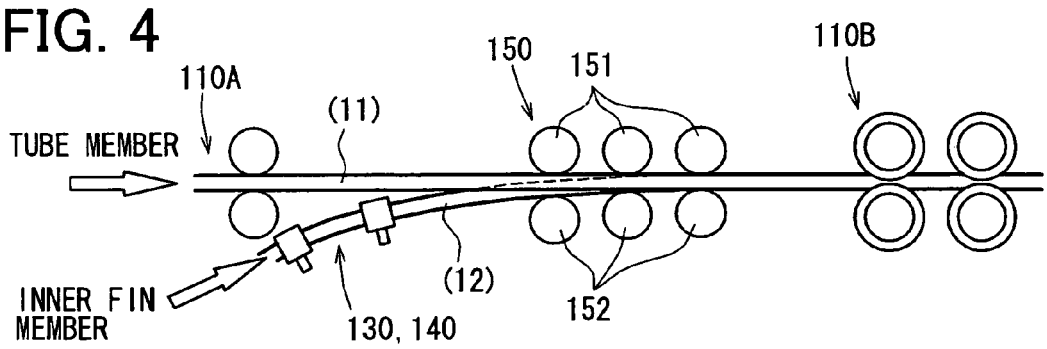
FIG. 4 is a side view mainly showing an inner fin shifting unit of a manufacture device according to a second embodiment of the present invention.

A second embodiment according to the present invention will be described with reference to FIGS. 4-5C. In this case, an inner fin shifting unit 150 is further arranged in front of the position where the inner fin member 12 is merged into the tube member 11 at the assembling/swaging portion 110B.

The inner fin shifting unit 150 includes multiple (e.g., three) roller groups, each of which includes a tube guide roller 151 and an inner fin guide roller 152.

Figure 5A:
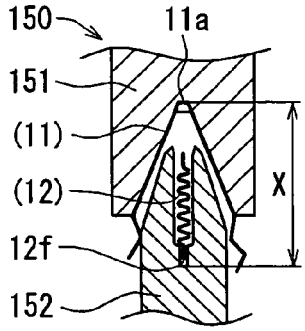
FIG. 5A is a cross-sectional view showing a roller group of the inner fin shifting unit which is arranged furthest to a forming side of a tube member among multiple roller groups according to the second embodiment.
Figure 5B:
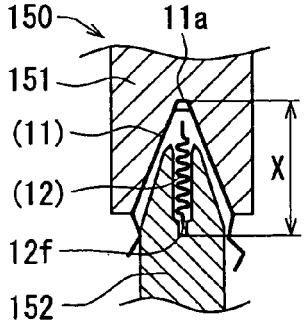
FIG. 5B is a cross-sectional view showing a roller group of the inner fin shifting unit which is arranged intermediately among the multiple roller groups according to the second embodiment.

FIG. 5A shows the roller group of the inner fin shifting unit 150 which is arranged furthest to the forming side (i.e., furthest to assembling/swaging portion 110B) of the tube member 11 among the roller groups. FIG. 5B shows the roller group of the inner fin shifting unit 150 which is arranged intermediately among the roller groups. FIG. 5C shows the roller group of the inner fin shifting unit 150 which is arranged closest to the forming side of the tube member 11 among the roller groups.

Figure 5C:
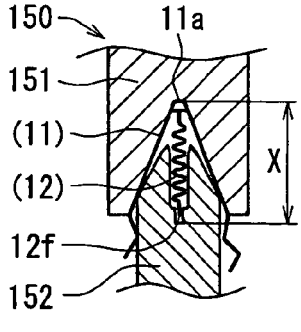
FIG. 5C is a cross-sectional view showing a roller group of the inner fin shifting unit which is arranged closest to the forming side of the tube member among the multiple roller groups according to the second embodiment.

Referring to FIGS. 5A-5C, each of the tube guide rollers 151 has a V-like groove formed at a periphery portion thereof. The bend portion 11*a* (side of other end of major axis direction of flat-shaped cross section of tube member 12) of the tube member 12 is guided by a bottom (guiding portion) of the V-like groove of the tube guide roller 151.

A periphery portion of each of the inner fin guide rollers 152 is provided with a slant surface (capable of being inserted into V-like groove of tube guide roller 151) to have a substantial mountain shape. The substantial center of the periphery portion of the inner fin guide roller 152 is provided with a groove. An outer side end 12*f* (i.e., opposite end to the side of bend portion 11*a*) of the inner fin member 12 which is to be inserted into the tube member 11 is guided by a bottom (guiding portion) of the groove of the inner fin guide roller 152.

As shown in FIGS. 5A-5C, among the multiple roller groups, the roller group is provided with a smaller guiding-portion distance X with being positioned closer to the forming side (forming direction) of the tube member 11. The guiding-portion distance X is between the guiding portion of the tube guide roller 151 and that of the inner fin guide roller 152 of the roller group. That is, the closer the roller group to the assembling/swaging portion 110B, the smaller the guiding-portion distance X of the roller group. In this case, the guiding-portion distance X of the roller group shown in FIG. 5A is largest among those of the multiple roller groups. The guiding-portion distance X of the roller group shown in FIG. 5C is smallest among those of the multiple roller groups.

In this case, among the multiple inner fin guide rollers 152, with the inner-fin guide roller 152 being positioned closer to the assembling/swaging portion 110B, the inner fin guide roller 152 is successively biased to the upper side and a depth (which is dimension in width direction of inner fin 12) of the groove (for guiding inner fin member 12) of the inner fin guide roller 152 is set successively smaller. Thus, the inner fin member 12 is consecutively raised with respect to the tube member 11 which is linearly moved.

Due to the operation of the inner fin shifting unit 150, the inner fin member 12 is provided with little twisted portions between the arrayed multiple roller groups (each which includes roller 151 and roller 152). Moreover, the inner fin member 12 is moved while the longitudinal direction of the inner fin member 12 becomes to correspond with that of the tube member 11.

Thus, the inner fin member 12 can be shifted along the tube member 11 and smoothly inserted into the tube member 11, without using a complicated mechanism.

Other Embodiments

Although the present invention has been fully described in connection with the preferred embodiments thereof with reference to the accompanying drawings, it is to be noted that various changes and modifications will become apparent to those skilled in the art.

In the above-described embodiments, the band-shaped inner fin 12 is provided with (via inner fin twisting unit 140) the twisted portions 12*d* and 12*e* which have the twist directions contrary to each other. However, the twist directions of the twisted portions 12*d* and 12*e* can be also set same to each other.

Moreover, the shape of the inner fin member 12 is not limited to that having the wave-shaped portion 12*a*. The inner fin member 12 can be also provided with other shape. For example, the inner fin member 12 can be provided with discontinuous unevenness, openings or the like.

Furthermore, in the above-described embodiments, the inner fin member 12 is provided with the flat (plane) plate portions 12*b* and the flat (plane) plate portion 12*c*, which is fixed to the swaged portion 11*c* of the tube member 11 by swaging. However, the inner fin member 12 can be only inserted in the tube member 11, without being fixed to the tube member 11 by swaging.

Moreover, the inner-fin tube 10 can be also used in other heat exchanger, for example, a radiator, a condenser, a heater core or the like.

In the above-described embodiments, the inner fin member 12 which is moved by the inner fin transferring unit 130 is provided with at least the two twisted portions. However, the inner fin member 12 and the tube member 11 can be also formed in such a manner that the inner fin member 12 is transferred toward the tube member 11. In this case, the inner fin member 12 can be provided with one twisted portion.

Moreover, in the above-described embodiments, the inner fin member 12 (flat plate portion 12*c*) is fixed to the tube member 11 by swaging, to construct the inner-fin tube 10. Therefore, when the inner-fin tube 10 having past through the assembling/swaging portion 110B is hauled by a haul roller or the like having a driving force, the inner fin member 12 at the previous process (performed via inner-fin transferring unit 130 and inner fin twisting unit 140) can be hauled together with the tube member 11. That is, it is unnecessary to provide the driving force for the roller portions 141-146 and the like (of inner fin transferring unit 130 and inner fin twisting unit 140) which are rotatable.

Such changes and modifications are to be understood as being in the scope of the present invention as defined by the appended claims.

What is claimed is:

1. A manufacture method for an inner-fin tube which has a tube member and an inner fin member, the tube member being constructed from a first band-shaped plate member which is bent so that the tube member defines therein a passage with a flat cross section perpendicular to a longitudinal direction of the tube member and is joined at a side of one end of a major axis direction of the flat cross section, the inner fin member being constructed from a second band-shaped plate material and arranged in the tube member, the manufacture method comprising:

continuously forming the tube member from the first band-shaped plate material in such a manner that the major axis direction of the flat cross section extends vertically and an open end is disposed at a lower end of the tube member;

continuously transferring the inner fin member constructed of the second band-shaped plate material in such a manner that the inner fin member is arranged apart from the tube member in a horizontal direction by a predetermined distance and in parallel to the tube member formed in the continuously forming step, the inner fin member being arranged at a lower side of the tube member;

twisting the inner fin member transferred in the continuously transferring step in order to alter a transfer direction of the inner fin member at least two separate times, so that the inner fin member faces the tube member and then the inner fin member faces the major axis direction of the flat cross section of the tube member, the cross section of the inner fin member being perpendicular to the transfer direction of the inner fin member; and inserting the inner fin member into the tube member through the open end of the lower end of the tube member which is at the halfway stage of the tube forming process, the transfer direction of the inner fin member having been changed during the twisting step.

2. The method according to claim 1, further comprising linearly transferring the inner fin member between a first twisting of the inner fin member and a second twisting of the inner fin member.

3. A manufacture device for manufacturing an inner-fin tube which has a tube member and an inner fin member, the tube member being constructed from a first band-shaped plate member which is bent so that the tube member defines therein a passage with a flat cross section perpendicular to a longitudinal direction of the tube member and is joined at a side of one end of a major axis direction of the flat cross section, the inner fin member being constructed from a second band-shaped plate material and arranged in the tube member, the manufacture device comprising:

a tube forming unit for continuously forming the tube member from the first band-shaped plate material in such a manner that the major axis direction of the flat cross section extends vertically and an open end is disposed at a lower end of the tube member;

an inner fin transferring unit for continuously transferring the inner fin member constructed of the second band-shaped plate material in such a manner that the inner fin member is arranged apart from the tube member in a horizontal direction by a predetermined distance and in parallel to the tube member formed by the tube forming unit, the inner fin member being arranged at a lower side of the tube member;

an inner fin twisting unit for twisting the inner fin member transferred via the inner fin transferring unit in order to alter a transfer direction of the inner fin member at least two separate times, so that the inner fin member faces the tube member and then the inner fin member faces the major axis direction of the flat cross section of the tube member, the cross section of the inner fin member being perpendicular to the transfer direction of the inner fin member; and an inner fin inserting unit for inserting the inner fin member into the tube member through the open end of the lower end of the tube member which is formed at the halfway stage by the tube forming unit, the transfer direction of the inner fin member having been changed at the inner fin twisting unit.

4. The manufacture device according to claim 3, wherein the inner fin twisting unit linearly transfers the inner fin member between a first twisting of the fin member and a second twisting of the fin member.

* * * * *